US007992303B2

(12) United States Patent
Liao

(10) Patent No.: US 7,992,303 B2
(45) Date of Patent: Aug. 9, 2011

(54) HAIR CLIPPER WITH IMPROVED BLADE CONTROL STRUCTURES

(76) Inventor: Yi-Tang Liao, Taichung County (TW)

( * ) Notice: Subject to any disclaimer, the term of this patent is extended or adjusted under 35 U.S.C. 154(b) by 643 days.

(21) Appl. No.: 12/022,441

(22) Filed: Jan. 30, 2008

(65) Prior Publication Data

US 2008/0178468 A1 Jul. 31, 2008

(30) Foreign Application Priority Data

Jan. 30, 2007 (DE) ..... 20 2007 001 336

(51) Int. Cl.
*B26B 19/02* (2006.01)
*B26B 21/00* (2006.01)
*B26B 19/00* (2006.01)
*B21K 21/00* (2006.01)

(52) U.S. Cl. ..... 30/43.91; 30/43.9; 30/47; 30/200; 30/49.53; 76/101.1

(58) Field of Classification Search ..... 30/47.91, 30/45, 200–202, 49.53; 76/101.1, 104.1
See application file for complete search history.

(56) References Cited

U.S. PATENT DOCUMENTS 2,306,039 A * 12/1942 Cromonic ..... 30/201
2,726,447 A * 12/1955 Maloy ..... 30/202
3,387,367 A * 6/1968 Merzon ..... 30/201
4,776,095 A * 10/1988 Tsujimoto et al. ..... 30/201
5,054,199 A * 10/1991 Ogawa et al. ..... 30/34.1
5,325,589 A * 7/1994 Kubo ..... 30/201
5,327,648 A * 7/1994 Ullmann ..... 30/43.1
5,367,772 A * 11/1994 Ogawa ..... 30/201
6,421,922 B2 * 7/2002 Beutel et al. ..... 30/216
2002/0000043 A1 * 1/2002 Beutel et al. ..... 30/216

* cited by examiner

*Primary Examiner* — Ghassem Alie
*Assistant Examiner* — Bharat C Patel
(74) *Attorney, Agent, or Firm* — Alan Kamrath; Kamrath & Associates PA

(57) ABSTRACT

An electric hair clipper with improved blade control structures for adjusting a scissors kit includes a combination housing provides a knob fitting portion, a pivot portion, an axial guiding slot, a motor receiving portion and a motor fixing portion. An adjusting knob provides a knob body and a pivot portion that pivots on the pivot portion of the combination housing, a turning operation portion around the adjusting knob for the finger to fiddle with and a pusher driving portion formed continuous various distance radially from the center of the pivot portion, an elastic orientation part is placed between the knob body and the combination housing. A motor unit is provided in the combination housing. A sliding pusher provides a body; a driven link portion that driven by the pusher driving portion of the adjusting knob to make the sliding pusher slide, a push head can push against the scissors kit.

7 Claims, 6 Drawing Sheets

HAIR CLIPPER WITH IMPROVED BLADE CONTROL STRUCTURES

BACKGROUND OF THE INVENTION

1. Field of the Invention

The present invention relates to a hair clipper and more particularly to an electric hair clipper with improved blade control structures.

2. Description of the Related Art

In prior art, an electric hair clipper kit usually provides a control device for adjusting the blade to a suitable cutting depth. The control device is a rotatable loop that mounts on the middle section of the hair clipper and cooperates with the transmission structures that sets inside the hair clipper to match a related or plurality related effects. However, the operation is inconvenience and structures inside the hair clipper are limited and the orientation effect is unclear. The disadvantages still need to improve.

SUMMARY OF THE INVENTION

The present invention has been accomplished under the circumstances in view. The main object of the present invention is to provide an electric hair clipper with improved blade control structures and the hair clipper can use a unique operation method to provide the easy moving and orientation effect. The sub object of the present invention is to provide an electric hair clipper with improved blade control structures and the transmission structures inside the hair clipper are simple and the link actions are clear.

DETAILED DESCRIPTION OF THE INVENTION

Figure 1:
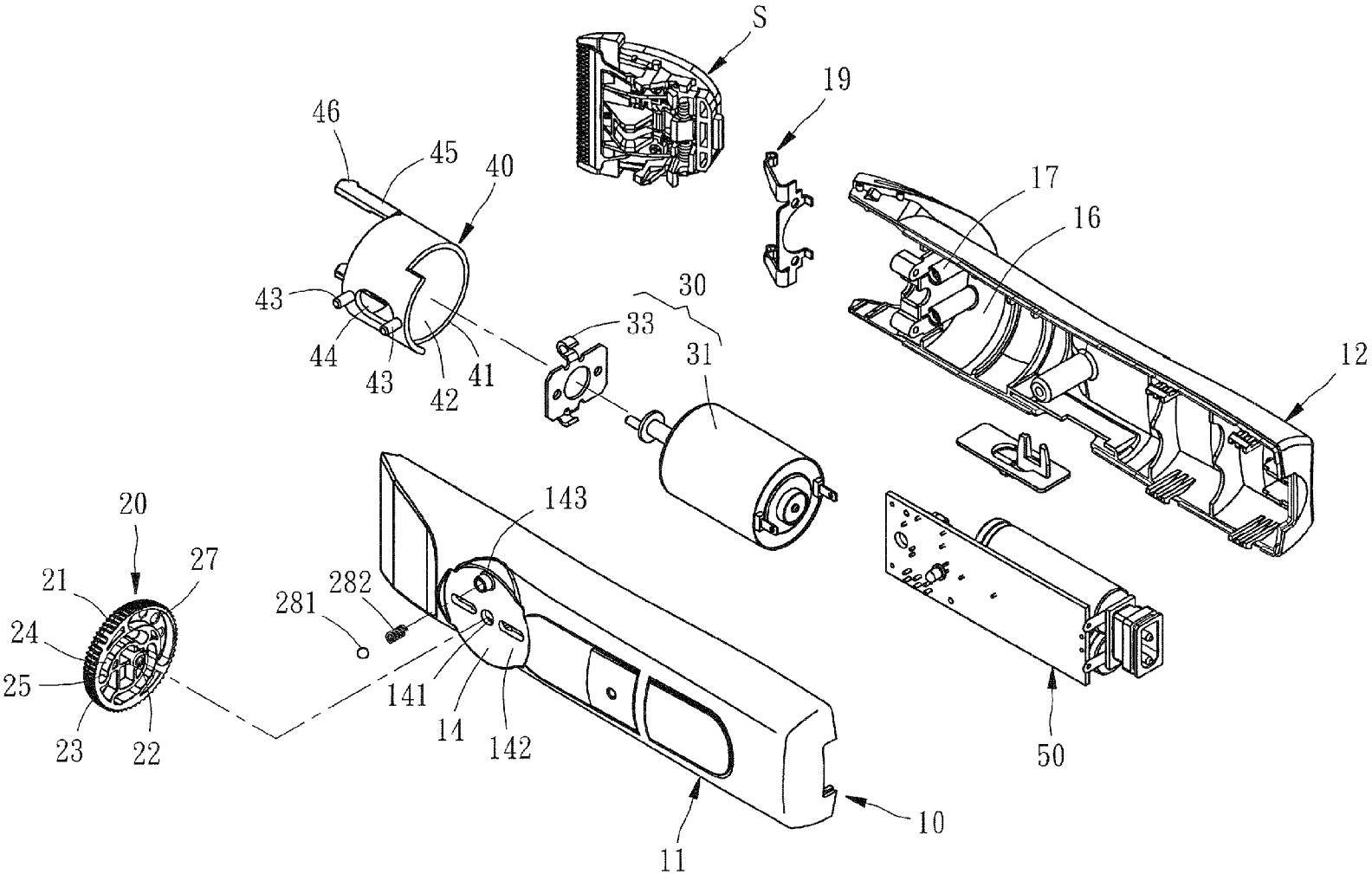
FIG. 1 is an exploded view of a hair clipper of a preferable embodiment according to the present invention.
Figure 2:
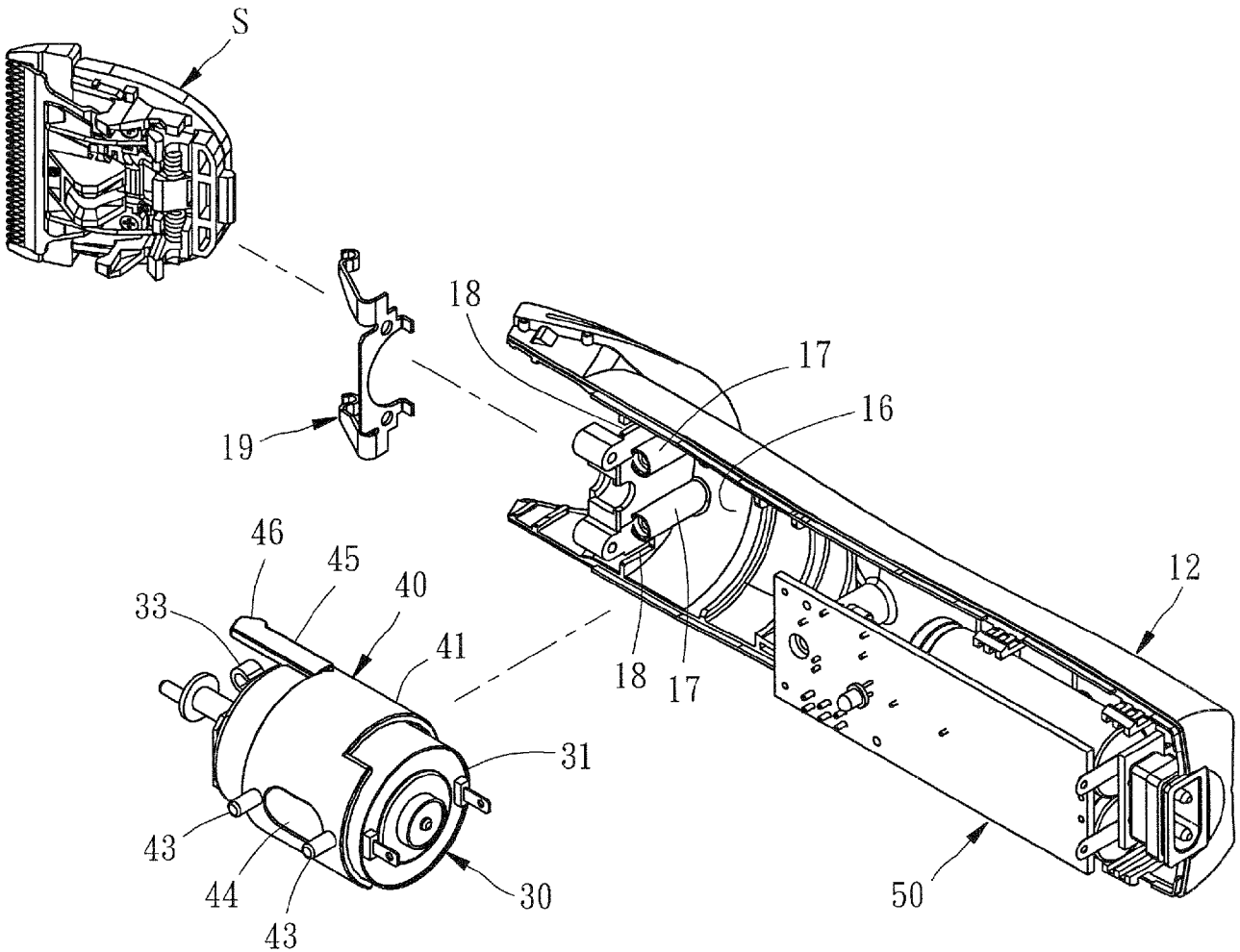
FIG. 2 is an exploded view of part of the hair clipper of the embodiment according to the present invention.
Figure 3:
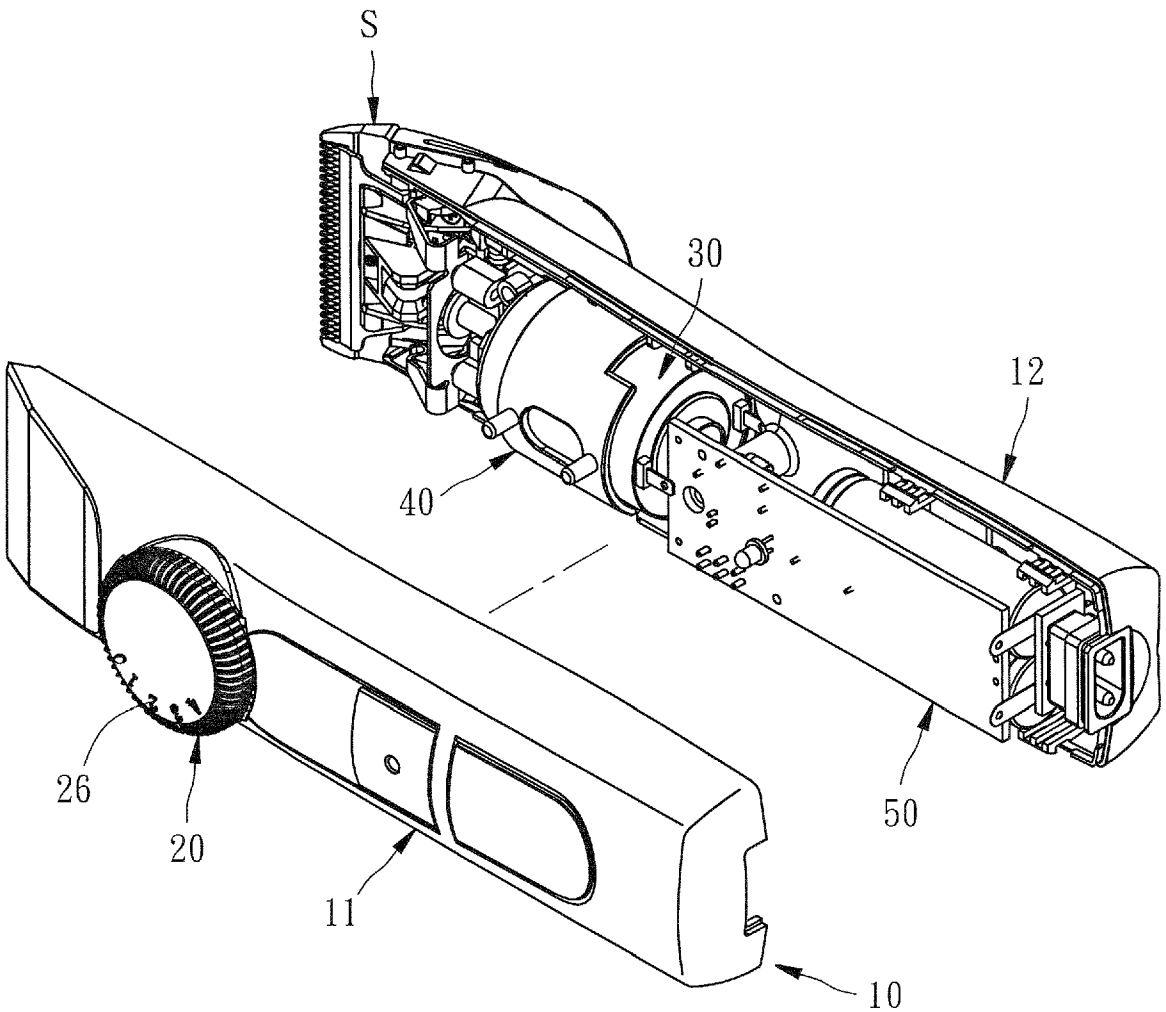
FIG. 3 is an exploded view of two sub-assembly of the embodiment according to the present invention.

Referring to the FIG. 1 to FIG. 3, an electric hair clipper with improved blade control structures is used to control a biasing unit S1 and a movable blade set S2 of a scissors kit S. The elements of the electric hair clipper are described as follows.

A combination housing 10 consists of a first shell 11 and a second shell 12. There is a knob fitting portion 14 provided on the first shell 11 and the knob fitting portion 14 provides a pivot portion 141, two axial guiding slots 142, and a pit 143. The first shell 11 combines with the second shell 12 to form a motor receiving portion 16, two motor fixing portions 17 which are two holes with a screw, and two coordination portions 18 which are two fillisters, and a scissors snapper 19 is mounted on the front end of the second shell 12 for snapping the scissors kit S onto the combination housing 10.

An adjusting knob 20 has a knob body 21 formed with a pivot portion 22 that pivots on the pivot portion 141 of the combination housing 10. There is a turning operation portion

23 around the adjusting knob 20 for the finger to fiddle with. Two pusher driving portions 24 that are two arc fillisters are provided at the same diameter and have one center eccentric from the pivot portion 22, and each pusher driving portion forms continuous various distance radially from the center of the pivot portion 22. A plurality of continuous orientation portions 25 are provided separately on the inside and outside flange of each pusher driving portion 24. An indicating sign 26 is placed on the up surface of the adjusting knob 20. A plurality of pits 27 are provided on the knob body 21. A steel ball 281 and a spring 282 are placed between the pit 27 of the adjusting knob 20 and the pit 143 of the combination housing 10 and the steel ball 281 unites with the spring 282 to form an elastic orientation part.

A motor unit 30 has a motor 31 with cylinder shape is placed inside the motor receiving portion 16 of the combination housing 10, a fixing supporter 33 connected to the motor 31 and screwed to the motor fixing portions 17 of the combination housing 10.

A sliding pusher 40 provides a body 41 with barrel shape and a cylinder space 42 therein. The sliding pusher 40 is movable placed around the motor 31 of the motor unit 30. Two driven link portions 43 can be moved with the pusher driving portion 24 of the adjusting knob 20 to make the sliding pusher 40 move axially. An escape hole 44 can receive the pivot portion 22 of the adjusting knob 20 and allows the pivot portion 22 to slide therein. Two match portions 45 are sliding provided in the coordination portions 18 of the combination housing 10 and the front end of each match portion 45 forms a push head 46 to push against the biasing unit S1 of the scissors kit S. The biasing unit S1 of the scissors kit S is received in the combination housing 10 and is biased between the push head 46 of the sliding pusher 40 and the movable blade set S2 of the scissors kit S. The movable blade set S2 of the scissors kit S protrudes outwardly from the combination housing 10 and can be pushed by the biasing unit S1 of the scissors kit S.

A battery set 50 is provided at a predestination place of the combination housing 10 therein.

Hereinafter are the descriptions of the operation method of present invention.

Figure 4:
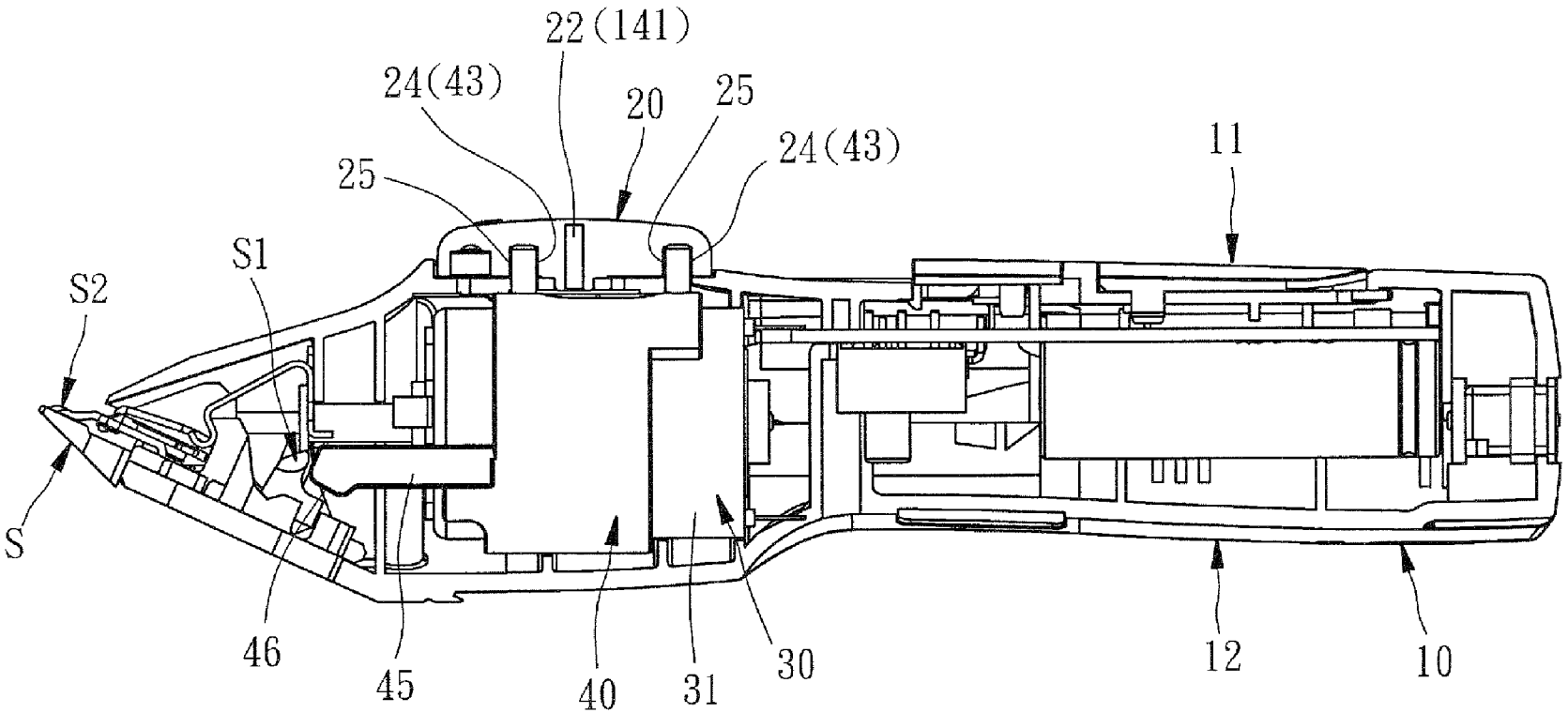
FIG. 4 is a longitudinal section view of the embodiment according to the present invention.
Figure 5:
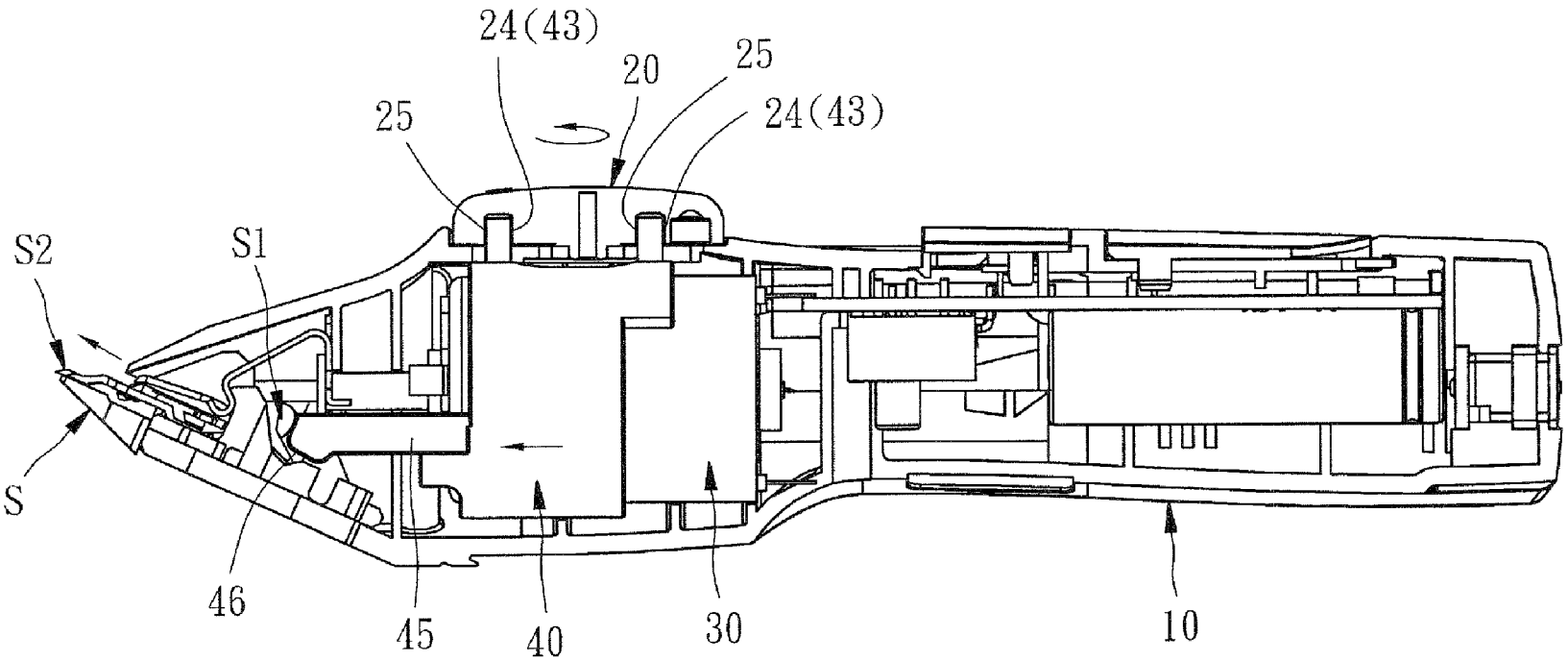
FIG. 5 corresponds to FIG. 4, showing a movable blade set of a scissors kit elevated forwards.

Referring to FIG. 4, by fiddling with the turning operation portion 23 of the adjusting knob 20 to rotate the adjusting knob 20, the pusher driving portion 24 of the adjusting knob 20 can push the driven link portions 43 of the sliding pusher 40 to move along an axis and force the sliding pusher 40 to move along an axis. The match portion 45 and the push head 46 will relate with the scissors kit S to push the biasing unit S1 biased and move the movable blade set S2 upward as shown in FIG. 5. So, the movable blade set S2 of the scissors kit S can be pushed and moved to protrude outward from the combination housing 10.

On the contrary, the scissors kit S will move downward if the adjusting knob 20 rotates in contrary direction.

Figure 6:
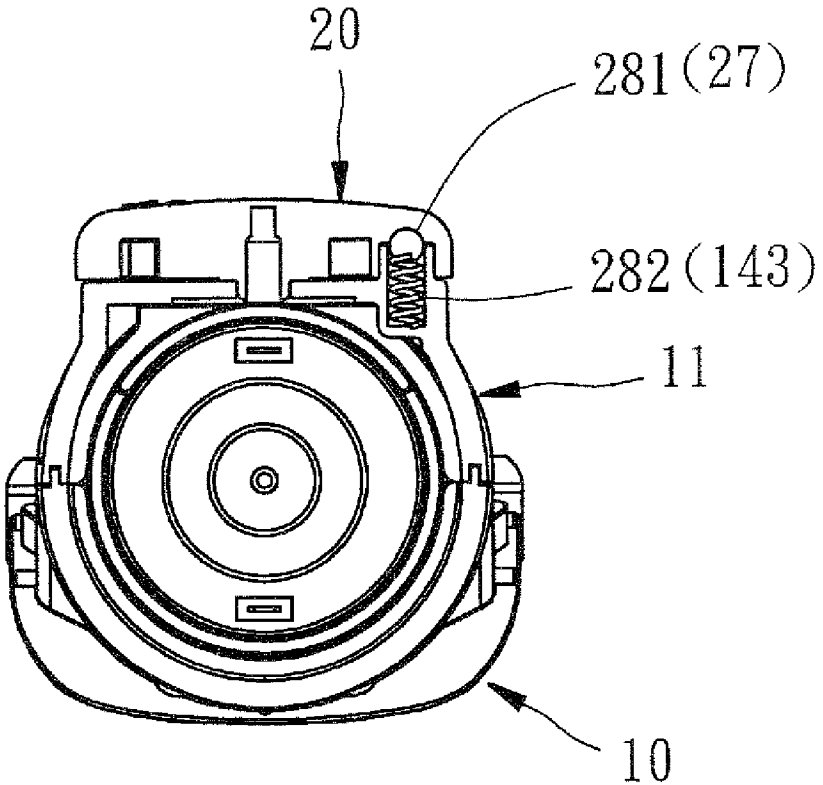
FIG. 6 is a transverse section view of the embodiment according to the present invention.

Referring to FIG. 6, because of the steel ball 281 is pushed by the spring 282; the steel ball 281 can provide an orientation effect by cooperating with the pit 27 of the adjusting knob 20. By this way, the adjusting knob 20 can be hold motionless and prevent the move that cause by shake.

Concluding with the aforesaid embodiment, the advantages of present invention are:

1. In the electric hair clipper with improved blade control structures of present invention, the hair clipper can use a unique operation method to provide the easy moving and orientation effect of the movable blade set of the scissors kit.

2. In the electric hair clipper with improved blade control structures of present invention, the transmission structures inside the hair clipper for the adjusting knob driving the sliding pusher are simple and the link actions are clear.

What is claimed is:

1. An electric hair clipper comprising:

a combination housing providing a knob fitting portion, a pivot portion, at least one axial guiding slot, a motor receiving portion and a motor fixing portion;

an adjusting knob with a knob body and a pivot portion that pivots on said pivot portion of the combination housing, a turning operation portion around said adjusting knob for a finger to fiddle with, at least one pusher driving portion forming continuous various distances radially from a center of said pivot portion of the adjusting knob, an elastic orientation part being placed between the knob body and said knob fitting portion of the combination housing;

a motor unit being provided at said motor receiving portion of the combination housing and fixed on said motor fixing portion of the combination housing;

a sliding pusher providing a body, at least one driven link portion that is driven by said pusher driving portion of the adjusting knob and moved along said axial guiding slot of the combination housing to make the sliding pusher move, a push head being provided on the sliding pusher and adapted to push against a scissors kit;

wherein said combination housing provides two axial guiding slots, said adjusting knob has two pusher driving portions and said sliding pusher has two driven link portions, said pusher driving portions of the adjusting knob that are arc fillisters being provided at one diameter and having one center eccentric from said pivot portion of the adjusting knob;

said pivot portion of the adjusting knob pivots to a center of said pivot portion of the combination housing by an axis;

wherein said combination housing further provides two coordination portions that are two fillisters, said sliding pusher provides two match portions slidingly placed in said coordination portions of the combination housing; and said sliding portion provides the body with barrel shape and a cylinder space, said sliding pusher is movably placed around the motor unit.

2. An electric hair clipper comprising:

a combination housing providing a knob fitting portion, a pivot portion, at least one axial guiding slot, a motor receiving portion and a motor fixing portion;

an adjusting knob with a knob body and a pivot portion that pivots on said pivot portion of the combination, housing, a turning operation portion around said adjusting knob for a finger to fiddle with, at least one pusher driving portion forming continuous various distances radially from a center of said pivot portion of the adjusting knob, an elastic orientation part being placed between the knob body and said knob fitting portion of the combination housing;

a motor unit being provided at said motor receiving portion of the combination housing and fixed on said motor fixing portion of the combination housing;

a sliding pusher providing a body, at least one driven link portion that is driven by said pusher driving portion of the adjusting knob and moved along said axial guiding slot of the combination housing to make the sliding pusher move, a push head being provided on the sliding pusher and adapted to push against a scissors kit;

wherein said combination housing provides two axial guiding slots, said adjusting knob has two pusher driving portions, and said sliding pusher has two driven link portions;

said pusher driving portions of the adjusting knob that are arc fillisters being provided at one diameter and having one center eccentric from said pivot portion of the adjusting knob;

said combination housing provides two coordination portions that are two fillisters, said sliding pusher provides two match portions slidingly placed in said coordination portions of the combination housing.

3. The hair clipper as claimed in claim 2, wherein said sliding pusher provides the body with barrel shape and a cylinder space, said sliding pusher is movably placed around the motor unit.

4. The hair clipper as claimed in claim 1, wherein each pusher driving portion of the adjusting knob provides a plurality of continuous orientation portions separately thereon, said knob body of the adjusting knob provides a plurality of pits to receive the elastic orientation part, said knob fitting portion of the combination housing provides a pit for said elastic orientation part to place.

5. An electric hair clipper comprising:

a combination housing providing a knob fitting portion, a pivot portion, at least one axial guiding slot, a motor receiving portion and a motor fixing portion;

an adjusting knob with a knob body and a pivot portion that pivots on said pivot portion of the combination housing, a turning operation portion around said adjusting knob for a finger to fiddle with, at least one pusher driving portion forming continuous various distances radially from a center of said pivot portion of the adjusting knob, an elastic orientation part being placed between the knob body and said knob fitting portion of the combination housing;

a motor unit being provided at said motor receiving portion of the combination housing and fixed on said motor fixing portion of the combination housing;

a sliding usher providing a body, at least one driven link portion that is driven by said pusher driving portion of the adjusting knob and moved along said axial guiding slot of the combination housing to make the sliding pusher move, a push head being provided on the sliding pusher and adapted to push against a scissors kit;

wherein said combination housing provides two coordination portions that are two fillisters, said sliding pusher provides two match portions slidingly placed in said coordination portions of the combination housing.

6. The hair clipper as claimed in claim 5, wherein said sliding pusher provides the body with barrel shape and a cylinder space, said sliding pusher is movably placed around the motor unit.

7. The hair clipper as claimed in claim 5, wherein each pusher driving portion of the adjusting knob provides a plurality of continuous orientation portions separately thereon, said knob body of the adjusting knob provides a plurality of pits to receive the elastic orientation part, said knob fitting portion of the combination housing provides a pit for said elastic orientation part to place.

* * * * *